United States Patent [19]

Bezler et al.

[11] Patent Number: 4,573,408

[45] Date of Patent: Mar. 4, 1986

[54] ADJUSTMENT ARRANGEMENT FOR CIRCUMFERENTIAL REGISTER IN ROTARY PRINTING MACHINES

[75] Inventors: Wilhelm Bezler, Augsburg; Ewald Stark, Fischach, both of Fed. Rep. of Germany

[73] Assignee: M.A.N.-Roland Druckmaschinen Aktiengesellschaft, Offenbach am Main, Fed. Rep. of Germany

[21] Appl. No.: 702,825

[22] Filed: Feb. 19, 1985

[30] Foreign Application Priority Data

Feb. 16, 1984 [DE] Fed. Rep. of Germany ..... 3405455

[51] Int. Cl.[4] ..... B41F 13/14

[52] U.S. Cl. ..... 101/248

[58] Field of Search ..... 101/248, 181, 137, 139, 101/140, 143, 144, 247; 100/164, 168; 74/395, 396, 397

[56] References Cited

U.S. PATENT DOCUMENTS

| | | | |
|---|---|---|---|
| 3,209,684 | 10/1965 | Blöchl | 101/248 |
| 3,363,554 | 1/1968 | Mestre | 101/248 |
| 3,367,263 | 2/1968 | Quenter | 100/168 |

*Primary Examiner*—J. Reed Fisher

*Attorney, Agent, or Firm*—Frishauf, Holtz, Goodman & Woodward

[57] ABSTRACT

To permit relative angular shifting of transmission of rotation between the first gear (1) and a second gear (2), to thereby control the register of a cylinder coupled to the second gear (2) with respect to printing cylinders coupled to the first gear, a third gear (3) is drivingly connected between the first gear (1) and the second gear. The third gear is journalled to rotate about an eccentric portion (6) of a shaft element (9), the shaft element 9 being secured for rocking movement about a central axis (10), from which the eccentric axis (11) is offset. The central axis (10) of the shaft element (9, 6) and the centers of rotation (12, 13) of the first and second gears, respectively, are positioned on a theoretical plane, or line (16) and when the eccentric axis (11) is also located on this theoretical line (16) a normal position is defined. By rocking the shaft element (9, 6) out of the normal position, the engagement (73) of the third gear with the pitch circle of the first gear is shifted away from the central axis (10) and, further, the engagement point (74) of the third gear with the pitch circle of the second gear (2) is shifted closer to the central axis, thereby causing an angular shift of the second gear with respect to the first gear. The shift is usually only a few degrees and can be controlled, in either direction, by an operating lever (20) which can be positioned manually or by a servo motor, to retain the third gear in the normal position, or shift the third gear out of the normal position for register adjustment.

10 Claims, 8 Drawing Figures

DISPLAY
D
A
B

ADJUSTMENT ARRANGEMENT FOR CIRCUMFERENTIAL REGISTER IN ROTARY PRINTING MACHINES

The invention relates to an arrangement for adjusting circumferential register in rotary printing machines, in which the forme cylinders are drivable via gear trains having spur gears meshing with one another.

BACKGROUND

Two principles for adjusting the circumferential register in rotary printing machines are known from the prior art: first, a rotary shift of the forme cylinders via a planetary gear, or second, an axial shift of helical gears in the drive trains. However, it is known per se that planetary gears necessitate an expensive gear mechanism. On the other hand, in apparatus with helical gears, usually only a relatively coarse adjustment is usually possible. Furthermore, the problem generally arises in these geared mechanisms either that there is a great amount of play, or if they are designed for play-free operation then that they are extremely expensive to manufacture.

THE INVENTION

It is an object of the invention to provide an apparatus for easily and accurately setting the circumferential register of printing cylinders by shifting the angular alignment of one cylinder with respect to another. Such a shift need not be extensive—usually a few degrees are sufficient—in order to establish register of printed subject matter.

Briefly, a first gear is in driving connection with the drive system of the printing machine, for example with a first cylinder; a second gear is in driving connection with the cylinder whose register is to be set with respect to the printing machinery drive system, and hence with respect to the first cylinder. A third gear is interposed between the first gear and the second gear to establish a driving connection therefor. The centers of the shafts of the first and second gears may be fixed. The third gear, however, is located on a shaft element which has a central axis, the shaft element being supported on the sidewalls in bearings concentric with the central axis. The shaft element has an eccentric portion thereon, and the third gear, establishing driving connection between the first and second gears, is journalled for rotation about an eccentric axis. When the centers of rotation of the first and second gears, as well as the central axis of the shaft element and the eccentric axis, are all in one theoretical plane extending axially with respect to the cylinders—in a drawing represented by a theoretical line—a normal position is defined. Upon rocking of the shaft element, the eccentric axis will be shifted out of alignment with respect to this theoretical line, or plane, while, however, maintaining meshing gearing engagement of the third gear with the first and second gears, respectively, to effect rotation transmission between the first and second gears. The engagement point of the third gear with the pitch circle of the first gear is thereby shifted away from the central axis while the engagement point of the third gear with the pitch circle of the second gear is shifted closer to the central axis, thereby causing an angular shift between the first gear and second gear upon rotation of all the three gears.

In accordance with the feature of the invention, the eccentric portion of the shaft element is readily shifted out of alignment with that theoretical line, or plane, by an engagement lever, coupled to the shaft element, the position of which can be accurately placed, manually, or by a servo motor system, thereby easily establishing register between printed output from cylinders driven, respectively, in dependence on rotation of the first gear, and of the second gear, respectively.

DRAWINGS

FIG. 1 shows an exemplary embodiment of an adjustment arrangement for circumferential register according to the invention, in partial section taken along the line I—I of FIG. 2;

FIG. 1*a* is a fragementary view showing a manual adjustment arrangement;

DETAILED DESCRIPTION

Figures 1, 1A:
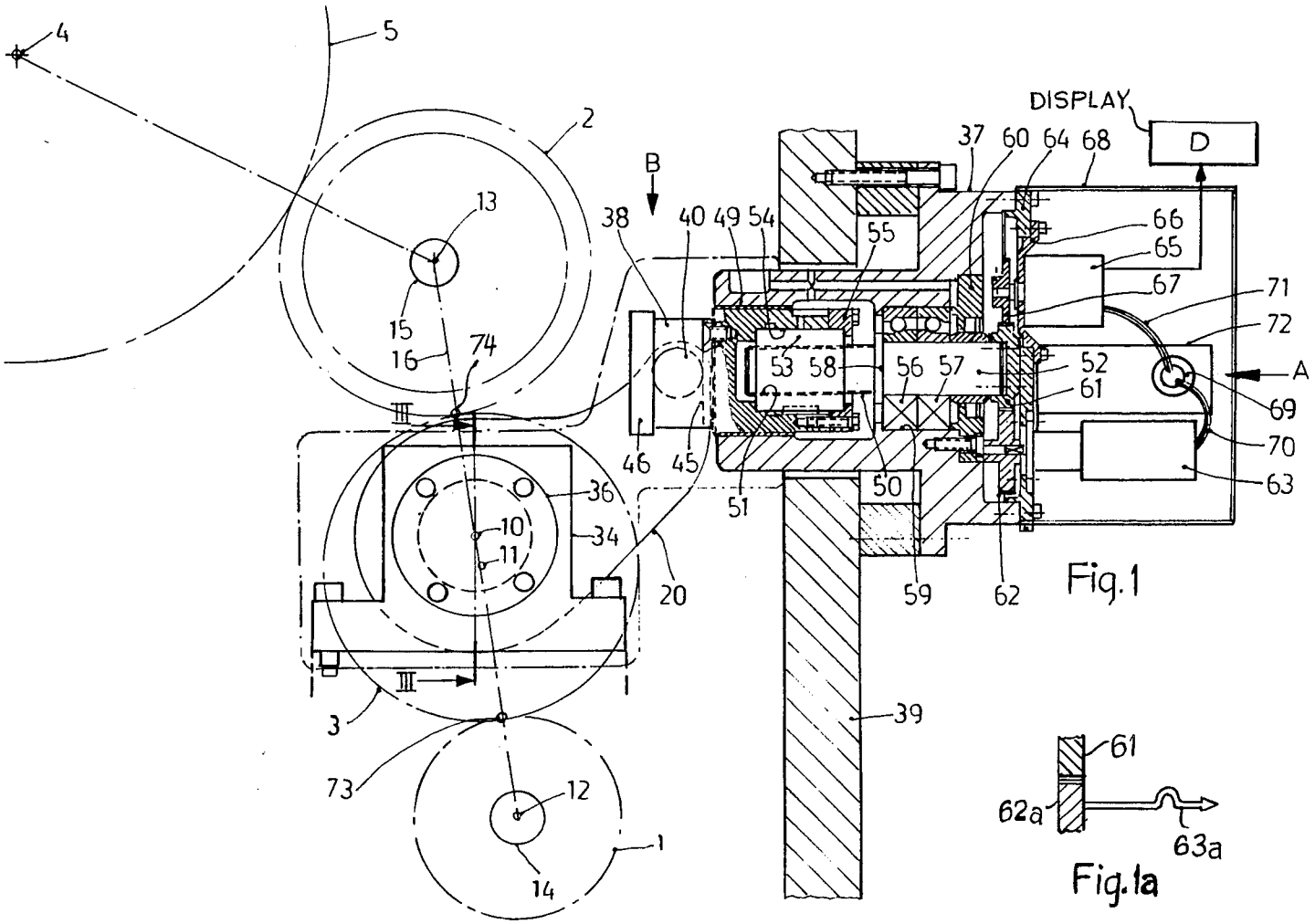

An adjustment arrangement for circumferential register will be described herein, in conjunction with the drawings, as part of a rotary printing machine, not otherwise shown or described, the forme cylinders of which are drivable via straight or spiral spur gear trains having meshing spur gears. In FIG. 1, the only part of such a gear train shown is that required for comprehending the circumferential register adjustment arrangement according to the invention. In the following description of this arrangement, a first gear 1, a second gear 2, and a third gear 3 of a gear train of this kind are referred to. These gears may be disposed at any arbitrary location inside a gear train of this kind, which drives a forme cylinder. The term "the first gear" does not necessarily mean that it is in fact the first gear in the sequence of spur gears in such a gear train.

The first gear 1 and a further gear 5, which rotates about the central axis 4 and meshes with the teeth of the gear 2, are supported in a fixed location in the rotary printing machine. The second gear 2, in contrast, can be shifted, in the present exemplary embodiment, out of engagement with the gear 3. To this end, it can be axially displaced along its central axis 13 and can thereby mesh with or be disengaged from the third gear 3. Means not shown are also present, which keep the second gear 2 in continuous engagement with the third gear 3 during the operation of the printing machine.

Figure 3:
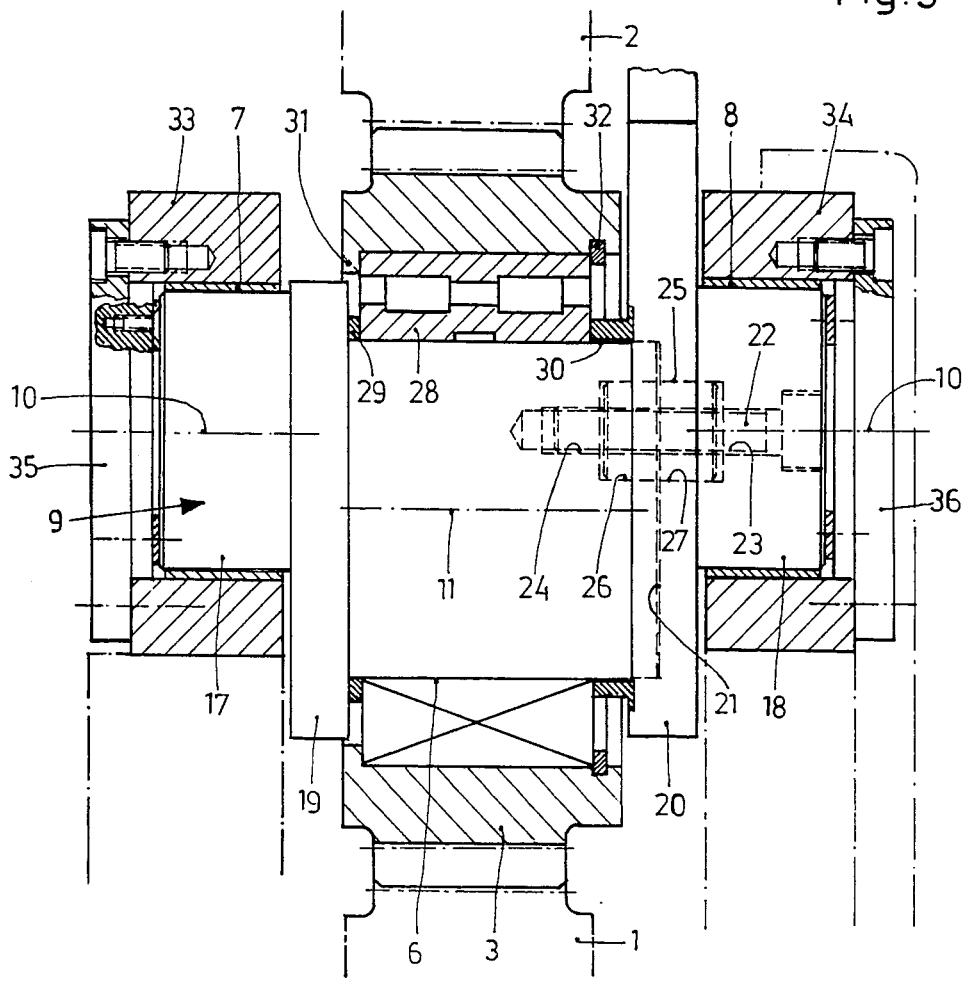
FIG. 3 is a section taken through the adjustment arrangement of FIG. 1 along the line III—III.

In accordance with the invention and as particularly shown in FIG. 3, the third gear 3 which is disposed between the first gear 1 and the second gear 2 and which establishes the driving connection between them is journalled on an eccentric portion 6 of a bearing shaft element 9 which is pivotable in stationary bearings 7, 8. This shaft element 9, in accordance with a further criterion of the invention, is connected to a rocking device which enables it to be rotated and thus also enables rocking of the eccentric portion 6 about an angle of a few degrees to both sides of a normal position.

In accordance with the invention, this normal position is defined such that, as particularly shown in FIG. 1, the central axis 10 of the shaft element 9, the central axis 11 of the eccentric portion 6 of the shaft element 9 and the central axes 12 and 13 of the shafts 14 and 15 of the first gear 1 and second gear 2 are located in a plane which is symbolized in FIG. 1 by a chain dotted line 16. As a result, the pitch circle of the first gear 1 is more remote from the central axis 10 of the shaft element 9 than is the pitch circle of the second gear 2, as a result, the angle of the second gear 2 relative to the first gear 1 can be adjusted by rocking the eccentric portion 6, with its center point 11, and hence rocking the third gear 3 as well. This will be described in greater detail below, when the function of the apparatus is described.

Details of the apparatus according to the invention which are particularly advantageous and are found in the exemplary embodiment shown will now be described.

The shaft element 9 comprises two axially aligned bearing trunnions 17 and 18 which have a round cross section, and between which the eccentric portion 6 extends. The eccentric portion 6, a flange 17 connected to one of its ends and the bearing trunnion 17 together form an integral structural unit. A second, also integral structural unit is formed by the other bearing trunnion 18 of the shaft element 9 and a pivot lever 20 of the rocking device, which will be described in further detail later. The pivot lever 20 has an indentation 21 into which the eccentric portion 6 is inserted without play with its end portion opposite from the flange 19. The connection beteween the unit formed by the bearing trunnion 18 and the pivot lever 20 and the eccentric portion 6 of the other unit, formed by the flange 19 and the bearing trunnion 17, is effected by means of a screw 22. This screw 22 is disposed coaxially with the central axis 10 of the shaft element 9, passes through a bore 23 in the bearing trunnion 18 and pivot lever 20, and engages a threaded blind bore 24 in the eccentric portion 6 which is axially aligned with the bore 23. In order that this screw 22 which engages the eccentric portion 6 eccentrically with respect to the central axis 11 of this eccentric portion 6 will not have to assume, in addition to its retaining function, the further function of preventing the relative rotation of the two structural units, a tubular twist separating sleeve 25 is provided. This sleeve 25 is spaced slightly apart from and coaxially surrounds the shank of the screw 22 and engages blind bore indentations 26 and 27, which are adapted to the outside diameter of the sleeve 25, respectively located in the eccentric portion 6 and in the integral unit of the bearing trunnion 18 and pivot lever 20. The pivot lever 20, which is formed from a flat plate, protrudes radially beyond the eccentric portion 6 on all sides, so that it is capable of assuming the same function as the flange 19. A roller bearing 28 is secured on the eccentric portion 6 and is axially fixed between the flange 19 and the pivot lever 20 by means of two spacer rings 29, 30. The third gear 3 rests, axially secured, on the outer ring of the roller bearing 28. To secure this third gear 3 axially, an annular protrusion 31 formed on this gear and a retaining ring 32 inserted into a groove of the bore receiving this gear are provided.

As already mentioned, the two bearing trunnions 17 and 18 of the shaft element 9 extend in stationary bearings 7 and 8; these bearings are embodied here by bearing bushes mounted in bearing blocks 33, 34 disposed in a stationary manner in the rotary printing machine. The exact axial position of the shaft element 9 inside the two bearing blocks 33, 34 is secured by bearing caps 35 and 36, which are firmly screwed to the outside of the bearing blocks 33 and 34, respectively.

The rocking device for the third gear 3 comprises not only the pivot lever 20, which extends at right angles to the central axis 10 of the bearing element 9 on which it is secured in a twist-free manner, but also a piston 38, which is rotatably connected to the outer free end of the pivot lever 20, is received in an adjusting housing 37 (FIG. 1) and is axially displaceable in the pivoting plane, and finally an adjusting mechanism connected to the piton 38. The adjusting mechanism is designed for precise displacement of the piston 38 in both axial directions. The adjusting housing 37 is secured to a wall 39 of the printing machine and is thus disposed in a rigid relationship with respect to the bearing blocks 33 and 34 supporting the shaft element 9 bearing the gear 3.

Figure 4:
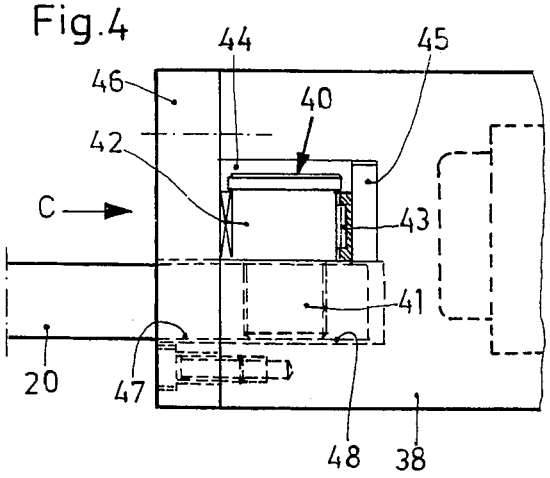
FIG. 4 is a view of a detail of the circumferential register adjustment arrangement of FIG. 1 in the direction indicated by the arrow B.
Figure 5:
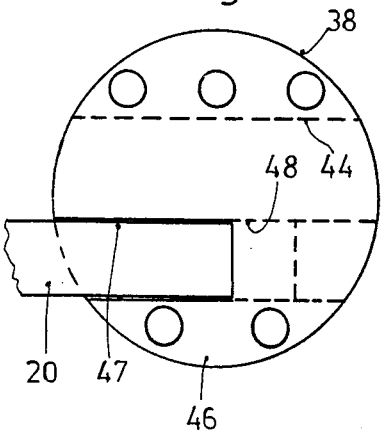
FIG. 5 is another view of the detail of the adjustment arrangement of FIG. 4 seen from the direction of the arrow C in FIG. 4.

The connection between the piston 38 and the pivot lever 20 is effected, in the variant shown in detail in FIGS. 4 and 5, in the vicinity of the outer free end of the pivot lever 20 by means of a bearing bolt 40, which with a threaded trunnion 41 engages a corresponding threaded bore of the pivot lever 20 and is firmly screwed thereto. Furthermore the bearing bolt 40 has a bearing trunnion 42, on which a roller bearing 43 is fitted. This roller bearing 43 is fitted without play with its outer cage in a recess 44 of the piston 38, by means of a shim 45 and a closure plate 46. The closure plate 46 embodies the end limitation of the piston 38; it is firmly screwed to the piston 38 and has a slit 47 (see FIG. 5), through which the pivot lever 20 extends and protrudes into a groove 48 of the piston 38.

With that part of the piston 38 with which it is connected to the pivot lever 20, the piston 38 protrudes out of the adjusting housing 37. Inside the adjusting housing 37 the piston 38 is guided without play in a bearing bush 49.

Referring again to FIG. 1, a rotatable but axially secured adjusting spindle 52 is provided as the adjusting mechanism for the piston in the illustrated embodiment. This adjusting spindle 52 is supported in the adjusting housing 37 and with a fine pitch trunnion 50 engages a corresponding adjusting threaded bore 51 of the piston 38; on the other end of the fine pitch trunnion 50 the adjusting spindle 52 is connected to an adjusting gear. The adjusting threaded bore 51 extends coaxially inside the piston 38, more specifically inside an adjusting threaded sleeve 53 inserted into the piston 38. The threaded sleeve 53 is secured axially as well as against twisting by means of a wedge and is received in a blind bore 54 of the piston 38; at one end it is supported on the flat bottom of the piston 38 and on the other end it is countered by a pressure plate 55, which acts as the other end limitation of the piston 38.

The adjusting spring 52 is journalled in the adjusting housing 37 via two staggered conical, or angular, ball bearings 56 and 57. These two ball bearings 56, 57 are fitted onto the adjusting spindle 52 as far as a radially protruding washer or flange 58 and are pressed into a receiving bore 59. They are supported at one end on the bottom of this bore 59; on the other end, they are retained in the assembled position by a counter plate 60 secured on the adjusting housing 37. The adjusting spindle 52 protrudes all the way through this counter plate 60 in the axial direction; outside the counter plate 60, the adjusting spindle 52 is connected to the adjusting gear mentioned above. As clearly shown in FIG. 1, a spur gear 61 is mounted, as part of this adjusting gear, on the end of the adjusting spindle 52 and secured against twisting by means of an eccentric screw.

For rotation of gear 61, a further gear 62 engages the teeth of this gear 61. Devices act upon this adjusting gear, which thus embodies one part of the control mechanism of the rocking device, in order to set this gear into motion.

For manual generation of the adjusting movements, as shown in FIG. 1*a*, a suitably retained gear 62*a* and a flexible cable 63*a*, coupled to a handle (not shown) are provided. Other drives for gear 61 can be used.

However, the adjusting devices in FIG. 1 are designed for generating the adjusting movements by a servo motor. To this end, an electric motor 63 is used, in particular a planetary gear motor. On the other side of the gears 61 and 62, the motor 63 is secured to a carrier plate 64, and it carries the spur gear 62 on its take-off shaft that protrudes through a bore of the carrier plate 64. The connection between the spur gear 62 and the take-off shaft is effected by positive engagement. The carrier plate 64 itself is screwed onto the outer end of the adjusting housing 37 in a vertical position relative to the axis of the adjusting spindle 52.

The rocking device includes, in addition to what has already been described, further devices for detecting and indicating or displaying adjusting movements that have taken place, or the instantaneous position in which the parts of the rocking apparatus and hence the third spur gear 3 as well are located. Used as such devices are a precision potentiometer 65, which is drivingly connected to the adjusting gear for the adjusting spindle 52, and a display device D connected to the precision potentiometer 65. The precision potentiometer 65 is likewise secured to the carrier plate 64 by its own retainer 66 and in its input shaft it has a spur gear 67, which with its teeth meshes with the spur gear 61 secured to the adjusting spindle 52.

Figure 2:
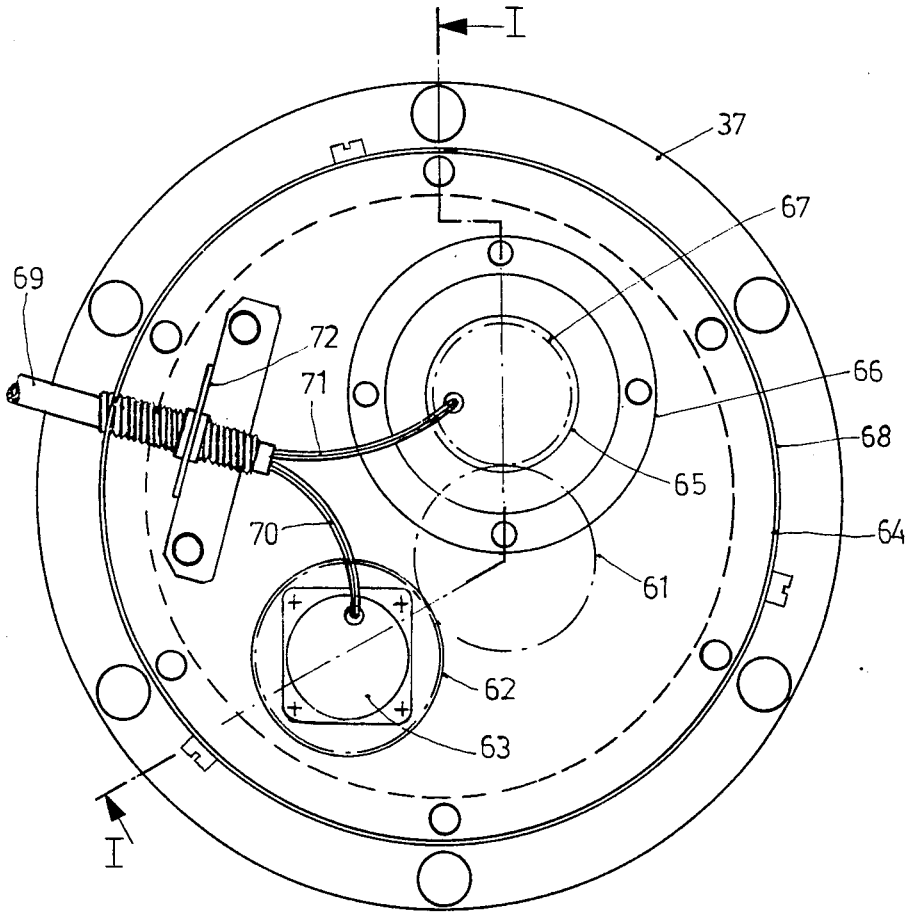
FIG. 2 is a view of parts of the adjustment arrangement of FIG. 1 in the direction indicated by the arrow A.

A protective hood 68 covering at least the electric motor 63 and the precision potentiometer 65 is secured on the carrier plate 64. A cable 69 is introduced through an opening in the wall of the protective hood 68, as best shown in FIG. 2. The cable 69 receives the electrical connecting leads for the electric motor 63 and the electrical signal transmission leads 71; the leads 71 connect the precision potentiometer 65 to the display device D. To assure precise arrangement of these connecting leads 70 or signal transmission leads 71, a cable holder 72 is provided inside the protective hood 68 and secured to the carrier plate 64.

The display device D and the device for starting up the electric motor 63 in order to adjust the third spur gear 3 may be disposed on the printing machine control panel or at some other suitable location in the printing machine.

Figure 6:
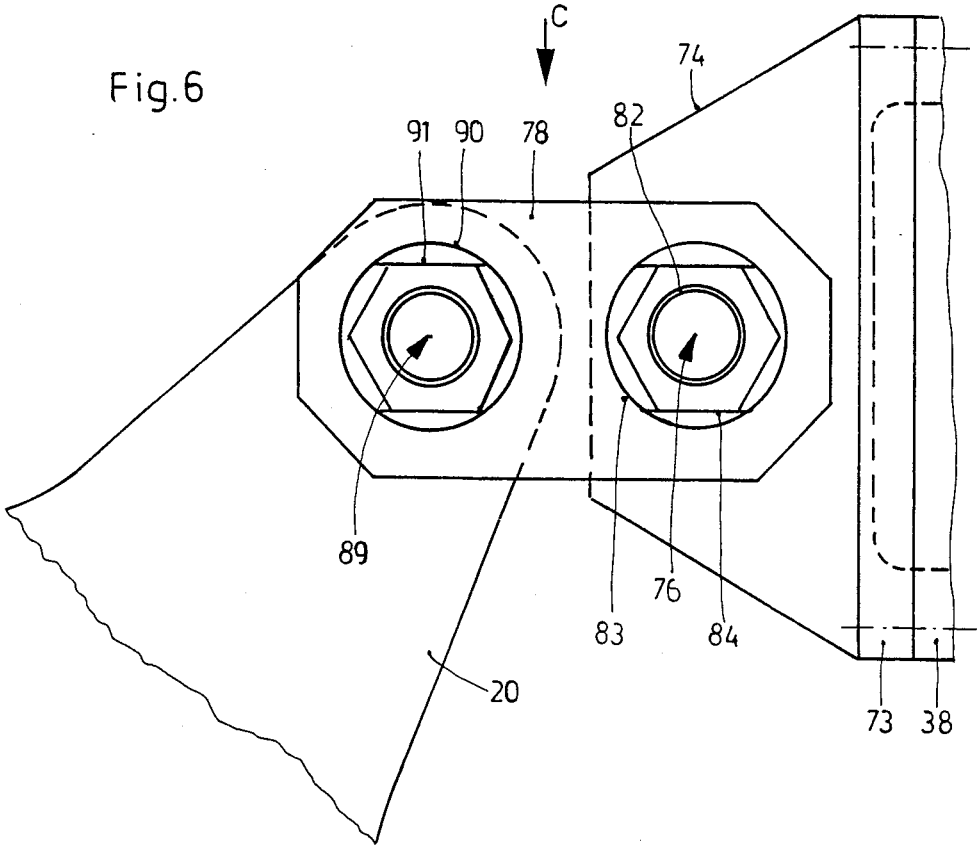
FIG. 6 is an alternative embodiment of the detail shown in FIG. 4.
Figure 7:
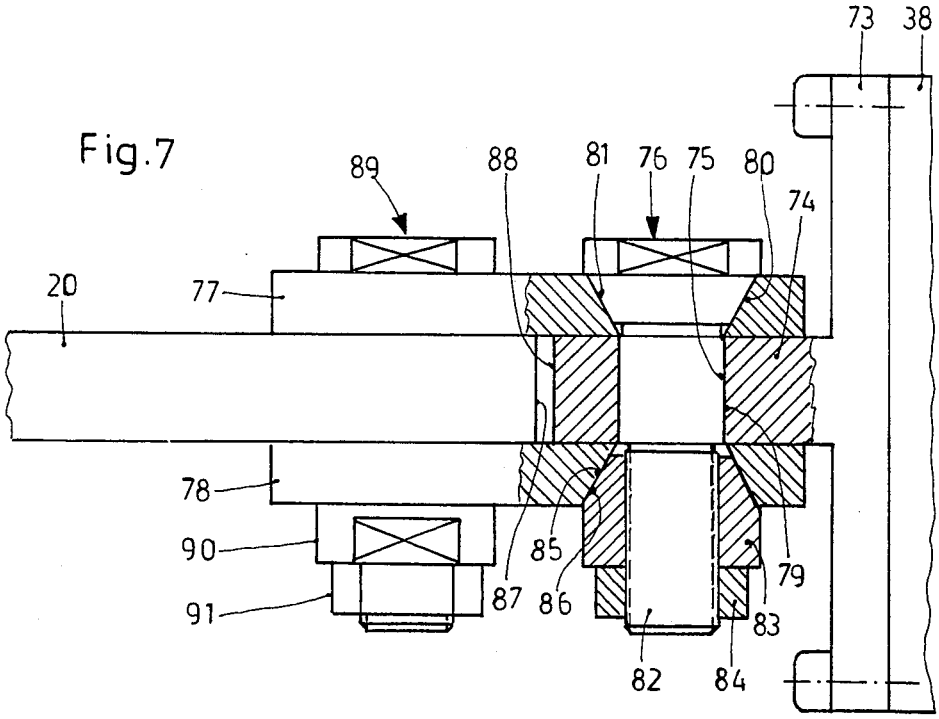
FIG. 7 is a view of the alternative embodiment of FIG. 6, seen in the direction of the arrow C in FIG. 4.

Alternatively to the connection between the piston 38 and the pivot lever 20 shown in detail in FIGS. 4 and 5, the pivot lever 38 may also be pivotably connected in the manner shown in FIGS. 6 and 7. Here a front plate 73 is secured to the outer end of the piston 38, carrying a centrally and vertically offstanding coupler plate 74 located in the plane of the pivot lever 20. The coupler plate 74 has a transverse bore 75, the axis of which intersects the axis of the piston 38 at right angles. The transverse bore 75 is pierced by a coupler bolt 76, which carries two connecting straps 77, 78, each at one end of the coupler plate 74.

The coupler bolt 76 has a bearing trunnion 79, with which it is fitted into the transverse bore 75 with little play. Furthermore the coupler bolt 76 has a head, which has flattened areas to which a tool can be applied and a bearing cone 80. The bearing cone 80 is supported on the wall of a correspondingly adapted cone bore 81 in the connecting strap 77. At the other end, the coupler bolt 76 has a threaded trunnion 82, on which a bearing nut 83 and a lock nut 84 are mounted; the lock nut 84 is provided to arrest the bearing nut 83. The bearing nut 83 has not only flattened areas to which a tool can be applied but also a conical face 85, which rests on the wall of a correspondingly adapted cone bore 86 in the connecting strap 78. Via these cones 80 and 85, the connecting straps 77, 78 are pressed against the coupler plate 74. The small amount of allowable play is established via the bearing nut 83, which is then arrested by means of the lock nut 84.

The connection between the pivot lever 20 and the two connecting straps 77, 78 is effected in the same manner as that in which the straps 77, 78 are articulated onto the coupler plate 74. The pivot lever 20, with a rounded end 87, is adjacent to and slightly spaced apart from the end 88 of the coupler plate 74 and has a transverse bore corresponding to the transverse bore 75. The transverse bore 75, like two further cone bores in the connecting straps 77, 78 and corresponding to the cone bores 81, 86, has a connecting bolt 89 passing through it. The bolt 89 is identical in embodiment to the connecting bolt 76 and also has both a bearing nut 90, corresponding to the bearing nut 83, and a lock nut 91, which corresponds to the lock nut 84.

OPERATION

Let it first be assumed that the third spur gear 3 is in the neutral normal position, in which the central axes 10, 11, 12 and 13 are located in the plane indicated by the chain dotted line 16.

Now when the gears are in this position, if poor printing of the goods being printed should occur, the printer, or machine operator, can decide whether a positive or a negative circumferential register adjustment should be made. Then, using the existing devices, the electric motor 63 is started up, causing the adjusting spindle 52 to rotate in the desired direction via the adjusting gears 61, 62. As a result, the piston 38 is axially displaced so that the pivot lever 20 articulated onto it pivots, thus also causing the eccentric portion 6 having the third gear 3 to pivot out of its normal position. This means that the central axis 11 of the eccentric portion 6 of the shaft element 9 is pivoted out of the plane indicated by the chain dotted line 16 in FIG. 1.

The spur gear 3, with its teeth, meshes with little play with the teeth of the spur gear 1. Upon this pivoting of the eccentric portion 6, the third gear 3 is therefore practically pivoted about the point 73 (FIG. 1) which, in the plane 16, indicates the point of contact between the pitch circles of the spur gears 1 and 3. By this pivoting about the point 73, the point 74 on the third spur gear 3 which is located diametrically opposite point 73 and which indicates the point of contact between the pitch circles of the spur gears 2 and 3 pivots out of the plane 16. Consequently the second spur gear 2 is compelled to undergo an angular adjustment relative to the first gear 1; the final result is a corresponding angular adjustment, via gear 5, of the driven forme cylinder.

The adjustment that is effected can be monitored by the operator of the printing machine via the precision potentiometer 65 and the display device D connected to it.

The angular adjustments of the second spur gear 2 that are possible, by pivoting the third gear 3, with the circumferential register adjustment apparatus according to the invention are on the order of magnitude of a few degrees to both sides of the normal position, thereby making it possible to attain extremely accurate adjustment of the circumferential register.

We claim:

1. In a rotary printing machine having a cylinder;

a plurality of meshing gears (1, 2, 3, 5) forming a gear train (1–3, 5) driving said cylinder, said meshing gears including a first driven gear (1) and a second gear (2) coupled in angularly fixed relation to said cylinder;

register adjustment apparatus for circumferential adjustment of the angular relation of the cylinder with respect to said first driven gear (1) by shifting the angular relationship between the first gear (1) and the second gear (2)

comprising, in accordance with the invention a third gear (3) drivingly connected between the first gear (1) and the second gear (2);

a shaft element (9, 6) having a central axis (10), said shaft element having an eccentric portion (6) which has an eccentric axis (11), eccentrically positioned with respect to said central axis, said third gear being journalled on said eccentric portion (6);

the central axis and the centers of rotation (12, 13) of the first and second gears (1, 2) being positioned on a theoretical plane (16), and wherein, when the eccentric axis (11) defining the center of the eccentric portion (6) is also on said plane, the eccentric portion is defined to be in a normal position;

and operating means (20; 38, 40–48, 50–63) coupled to the shaft element (9, 6) for effecting an adjusting movement by rocking the shaft element about the central axis (10) and thereby shifting the eccentric axis (11) out of said normal position, while maintaining meshing engagement between the first and third gears (1, 3) and the second and third gears (2, 3), respectively, and thereby rotation transmission between the first and second gears (1, 2) while shifting the engagement point (73) of the third gear (3) with the pitch circle of the first gear (1) away from said central axis (10) and further shifting the engagement point (74) of the third gear (3) with the pitch circle of the second gear (2) closer to said central axis (10), thereby causing an angular shift of the second gear (2) with respect to the first gear.

2. Apparatus according to claim 1 wherein said operating means comprises a lever (20) having one end portion coupled to said shaft element (9);

piston means (38) engageable with the inner end portion of the lever (20);

a housing (37) retaining said piston means (38);

bearing (33, 34) for said shaft element;

and positioning means (40–48, 50–53) coupled to the piston means (38) for accurately moving said piston means in two axial directions from a normal centered position;

and wherein said housing and said bearings are supported on the printing machine.

3. Apparatus according to claim 2 including an adjusting mechanism for the positioning means comprising an adjusting spindle (52) supported rotatably but axially secured in the housing (37) and with a fine pitch trunnion (50) engaging a corresponding adjusting threaded bore (51) of the piston (38), the spindle (52) being connected at the other end of the fine pitch trunnion (50) to an adjusting gear (61, 62).

4. Apparatus according to claim 3 wherein the adjusting mechanism of the positioning means has devices acting upon parts of the adjusting gear (61, 62) and setting them in motion.

5. Apparatus according to claim 4 wherein said devices are designed for a manual generation of adjusting movement.

6. Apparatus according to claim 4 wherein said devices are designed for electric servo motor generation of adjusting movement.

7. Apparatus according to claim 6 wherein an electric motor (63), in particular a planetary gear motor, is used as a device for generating the adjusting movement which can be induced in the adjusting gear (61, 62).

8. Apparatus according to claim 1 wherein the operating means includes means for sending and displaying a representation of effected adjusting movement or the instantaneous position of the third gear (3).

9. Apparatus according to claim 3 wherein a precision potentiometer (65) is provided drivingly connected to the adjusting gear (61, 62) and a display device (D) is provided connected to the precision potentiometer.

10. Apparatus according to claim 1 wherein the operating means include essentially play-free structural, connected operating components.

* * * * *